US005411393A

United States Patent [19]

Askin et al.

[11] Patent Number: 5,411,393

[45] Date of Patent: May 2, 1995

[54] PREMIX BURNER FOR FURNACE WITH GAS ENRICHMENT

[75] Inventors: Kerim Askin; John D. Butler, both of Carroll County, Ga.

[73] Assignee: Southwire Company, Carrollton, Ga.

[21] Appl. No.: 46

[22] Filed: Jan. 4, 1993

[51] Int. Cl.[6] ..... F23D 21/00

[52] U.S. Cl. ..... 431/8; 431/181; 431/186

[58] Field of Search ..... 431/181, 187, 189, 186; 122/6.6; 266/47, 223, 266

[56] References Cited

U.S. PATENT DOCUMENTS

| | | | |
|---|---|---|---|
| 941,833 | 11/1909 | Williams . | |
| 1,321,996 | 11/1919 | Dreffein . | |
| 1,469,326 | 10/1923 | Mahr . | |
| 1,887,015 | 11/1932 | Green et al. | 431/186 X |
| 2,087,869 | 7/1937 | Blodgett | 431/186 X |
| 2,360,548 | 10/1944 | Conway . | |
| 2,380,463 | 7/1945 | Poole | 431/186 X |
| 3,100,461 | 8/1963 | Werner | 431/189 |
| 3,220,803 | 11/1968 | Billi . | |
| 3,533,717 | 10/1970 | Guerin . | |
| 4,154,571 | 5/1979 | Pariani . | |
| 4,156,590 | 5/1979 | Pariani . | |
| 4,262,371 | 4/1981 | Berry et al. . | |
| 4,301,997 | 11/1981 | Berry et al. . | |
| 4,473,350 | 9/1984 | Gitman . | |
| 4,493,271 | 1/1985 | Ohayon et al. . | |
| 4,626,204 | 12/1986 | Saint Julian et al. | 431/186 X |
| 4,865,297 | 9/1989 | Gitman . | |
| 4,924,784 | 5/1990 | Lennon et al. | 110/262 X |
| 4,988,287 | 1/1991 | Stegelman | 431/189 |
| 5,071,105 | 12/1991 | Donze et al. . | |
| 5,209,893 | 5/1993 | Askin et al. | 431/186 X |

FOREIGN PATENT DOCUMENTS

| | | | |
|---|---|---|---|
| 891597 | 8/1953 | Germany | 110/262 |
| 2343991 | 3/1974 | Germany . | |
| 377474 | 7/1932 | United Kingdom | 110/262 |
| 1260443 | 1/1972 | United Kingdom | 431/186 |
| 0781501 | 11/1990 | U.S.S.R. | 431/186 |

*Primary Examiner*—Carl D. Price

*Attorney, Agent, or Firm*—Stanley L. Tate; James W. Wallis, Jr.

[57] ABSTRACT

An improved premixed gaseous fuel burner for a metal processing furnace includes an axially adjustable gas supply tube concentrically positioned within the burner body for delivering a flow of oxidant or other gaseous fuel component to the combustion chamber of the furnace. Axial repositioning of the air tube controls the spread of oxidant at the core of the flame, thereby controlling flame temperature and the operating environment of the combustion chamber and furnace. A flow mixer having a pair of helically arranged vanes provided in the annular space between the supply tube and the burner body imparts turbulent swirl to the premixture flow to cause enhanced mixing of the premixture. The gas supply tube is externally adjustable and includes a peep sight for externally viewing the flame in the furnace.

6 Claims, 1 Drawing Sheet

PREMIX BURNER FOR FURNACE WITH GAS ENRICHMENT

FIELD OF THE INVENTION

The present invention relates to metal processing furnaces, and, more particularly to a burner apparatus having an adjustable tubing or pipe for introducing an enriching gas flow into a furnace, which is particularly adapted for use in premixed gas-fired furnaces in which various materials, such as metals and their alloys, are processed.

BACKGROUND OF THE INVENTION

Modern metal melting and holding furnaces utilize liquid or gaseous fuels which are delivered, usually in combination with an oxidant, to a plurality of burners which are directly exposed to the material to be processed. Furnaces designed for the processing of metals may operate within a relatively wide range of temperatures related to any of the various metal processing stages and the particular metal or metal alloy to be processed. Furthermore, selective manipulation of various fuels and oxidant compositions, at specified processing temperatures, yields an oxidizing or reducing processing environment. These processing furnaces are often uniquely configured with a variety of burner arrays installed therein, to provide the required heating characteristics. For example, vertical shaft type furnaces for melting metal are well known in the art, as typified by the furnace disclosed in U.S. Pat. No. 4,301,997 assigned to the assignee of this invention. Correct selection of an appropriate fuel/oxidant combination for use at a selected processing temperature and in a desired furnace environment are important factors which materially effect the processing of metals and their alloys.

Most modern premixed gas-fired metal processing furnaces are heated by passing a specified mass flow of a pressurized mixture of fuel and an oxidant through a metered orifice to the combustion chamber of the furnace. Such oxidants include, for example, atmospheric air, gaseous oxygen, or combinations of oxygen containing gases. The mixture is ignited by an appropriate ignition system, causing steady state combustion of that mass flow within the refractory-lined combustion chamber of the furnace. Burner temperature, flame propagation, and flame stability vary with fuel composition, fuel-oxidant ratio, fuel mixture delivery pressure, various orifice dimensions, and the resulting flow characteristics. Accordingly, a measurable change in any of these parameters may cause a related and undesirable variation in temperature, operating environment, or other operating characteristic within the furnace. In particular, an oxidizing, reducing, or neutral (stoichiometric) atmosphere can be approximated by selectively altering one or more of these variables singly or in combination. Heretofore, however, precise achievement of a desired combustion atmosphere has been accomplished on a hit-or-miss basis for two reasons. First, insufficient and uneven premixing of the fuel flow with an oxidant flow may result in an inconsistent or erratic fuel burn due to non-uniform flame propagation following ignition. Second, partial burning of the fuel often occurs as a result of a premix which is overly rich in the oxidant component, in which case the excess oxidant effectively cools the flame. The resulting cooler flame may be inadequate for those process melts which require relatively high flame temperatures to prevent premature solidification and to remelt already solidified material.

It is well known that an increased mass flow of an oxidant, beyond that required for stoichiometric combustion conditions, can enhance the resulting flame temperature, which is necessary for refining those metals and their alloys having elevated melting points. Alternatively, enhanced processing temperatures can enhance production capacity of the shaft furnace. Such processing requires, in combination with a fuel supply, an increase in the mass flow of oxidant supplied to the burner. However, significant additions of oxidant can result in the rapid and undesirable oxidation of the material being processed if such additions are made in an uncontrolled or insufficiently premixed manner.

In addition, it may be desirable to provide increased processing temperatures while maintaining the reducing atmosphere generally required for the processing of readily-oxidized metals such as copper, aluminum, and their alloys. Increased temperatures are also necessary for the efficient processing of the by-product slags of these metals and their alloys. However, accomplishment of such temperatures by oxidant-enrichment is limited to the extent necessary to maintain the reducing atmosphere within the furnace. Thus, an increase in flame temperature is limited by the oxidant component of the premixture mass flow and by the resulting flame shape and chemistry defined by that ignited premixture mass flow. That is, unbalanced gas-mixing results in a non-uniform fuel burn which in turn provides an erratic or uncertain temperature. Such incomplete combustion also results in excess use (waste) of fuel and oxidant. Furthermore, excess oxidant flow may result in undersirable cooling of the burner and/or metal charge. Accordingly, such insufficient control of gas premixing, and mixing within the burner, results in non-optimized burner and flame temperature, thereby providing insufficient heat necessary to meet elevated melt temperature requirements, and compromising metal throughput of the furnace.

SUMMARY OF THE INVENTION

It is therefore an object of the present invention to provide a burner apparatus for a premixed, gas-fired metal processing furnace for controllably and adjustably introducing and enhancing a premixed fuel and oxidant flow to the combustion chamber of the furnace.

It is another object of the present invention to provide a burner apparatus, wherein the burner apparatus provides a uniform premixing of the fuel and oxidant flow that may be enriched with an adjustable ancillary flow of fuel or oxidant to enhance uniform flame propagation following ignition.

It is a further object of the present invention to provide a burner apparatus for controlling an adjustable ancillary oxidant or fuel flow to selectively establish a desired flame chemistry, shape, and temperature.

It is yet another object of the present invention to provide a burner apparatus for optimizing a desired reducing, stoichiometric, or oxidizing environment in furnaces fired by a premixed gaseous fuel.

It is a further object of the present invention to provide a burner flame adjustment apparatus, wherein the adjusted burner flame is viewable from a point external of the furnace and the burner apparatus.

The present invention provides an adjustable burner apparatus for a metal melting furnace which utilizes a gaseous fuel mixed with an oxidant, such as compressed oxygen or air. In particular, the invention provides for the introduction of an ancillary oxidant flow to the combustion chamber through a concentrically disposed, axially adjustable gas supply tube or pipe provided in the burner body. Adjustment of the combustion chamber or inner end of the supply tube is achieved by manipulation of the opposite or outer end thereof at the external terminus of the burner body. A peep sight is located at the outer end of the supply tube which is secured in position by a gland nut provided on the burner body or by other suitable means.

A pair of helical vanes are provided at an intermediate position on the supply tube in an annular arrangement so as to be positioned in the tubular flow path of the premixture flow. During burner operation, the vanes impart a turbulent swirl to the premixture flow which assures more complete mixing of the premixture and more complete ignition in the combustion chamber of the furnace.

The supply tube is axially adjusted during burner operation as necessary to introduce a secondary gas flow, such as a supply of oxidant or other selected gas for enriching the premixture by an amount sufficient to alter flame temperature while maintaining an appropriate reducing, stoichiometric, or oxidizing atmosphere in the furnace. The supply tube is also adjustable so as to provide a cone of non-combusting gas adjacent to a portion of a surface of the metal to be processed. Accordingly, the flame characteristics of the burner and the environment of the combustion chamber may be precisely controlled and adjusted to a degree heretofore unknown in the art.

With the foregoing and other objects, advantages and features on the invention that will become hereinafter apparent, the nature of the invention may be more clearly understood by reference to the following detailed description of the invention, the appended claims, and to the several views illustrated in the attached drawings.

DETAILED DESCRIPTION OF THE INVENTION

Figure 1:
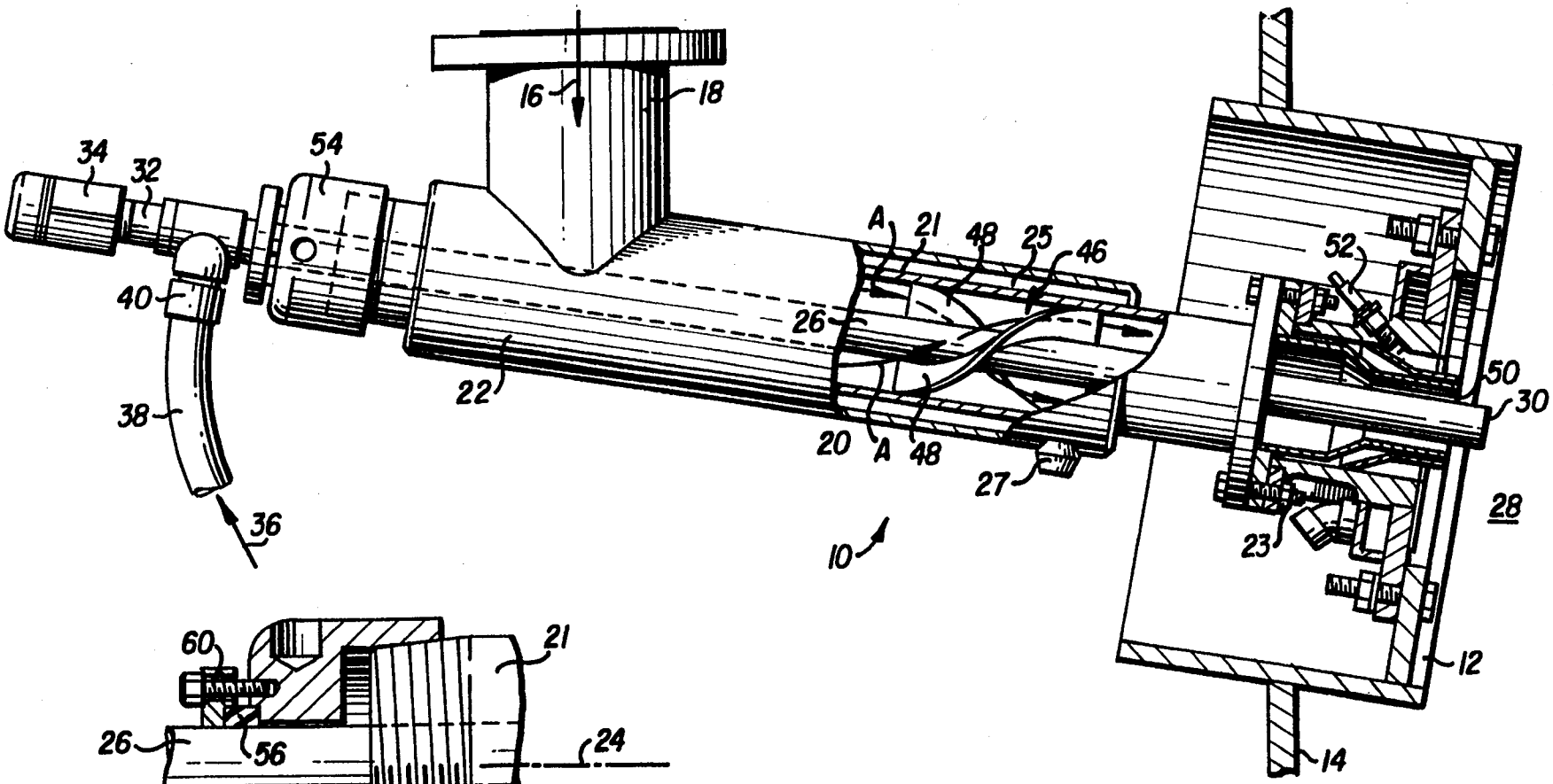
FIG. 1 is a side view, partly in cross-section, of the adjustable gas burner apparatus assembly of the present invention as installed in a burner port in a metal processing furnace.

Referring now in detail to the drawings wherein like parts are designated by like reference numerals throughout, there is illustrated in FIG. 1 an adjustable burner assembly 10 of the present invention installed through a burner port 12 in a wall 14 of a metal processing furnace (not shown), such as a vertical shaft furnace of the type disclosed in U.S. Pat. No. 4,301,997, the disclosure of which is incorporated herein by reference. A fuel/air premixture represented by arrows 16 is directed through a premixed gas inlet 18 which opens into a bore 20 of a flow tube 21 in burned body 22 having a longitudinal axis 24. The mixture 16 is then directed through the flow tube 21 in the direction of the axis 24 to the burner outlet 23 in burner port 12. The burner body 22 and flow tube 21 are cooled during furnace operation by water flow through a water jacket 25 in a conventional manner. Water inflow is provided through a nipple 27 in the burner body 22, and is then circulated through the water jacket 25 and discharged at an outflow nipple (not shown).

A gas supply tube 26 is provided in the burner body 22 concentric with the bore 20 and tube 21 for introducing an ancillary or secondary flow of gas, such as an oxidant, represented by arrow 36 to the combustion chamber 28 of the furnace through a first end 30 of the supply tube 26. Alternatively, the secondary gas flow may comprise a gaseous fuel. The opposite, or second end 32 of the supply tube 26 extends axially through the external terminus of the burner body 22, and is threaded to receive a conventional peep sight 34. The ancillary flow 36 is directed to the supply tube 26 through a flexible supply conduit 38 which is affixed thereto by a gas-tight connector 40.

A flow mixing means 46 comprising a pair of helically arranged vanes 48 is provided at an intermediate position on the supply tube 26 in an annular arrangement between the inner diameter of the flow tube 21 and the outer diameter of the supply tube 26, and within the flow path of the fuel/air mixture 16 in bore 20. The convolute surfaces of the vanes 48 are formed in a helical spiral having a substantially constant pitch in the direction of the longitudinal axis 24.

According to the preferred embodiment of the present invention, the flow mixer 46 is integrally attached to the supply tube 26 (as by welding) and is slidingly engaged with the inner diameter of the flow tube 21 so as to guide the supply tube 26 coaxially within the tube 21. Alternatively, the flow mixer 46 may be integrally attached to the flow tube 21, or it may be an element separate from the flow tube 21 and supply tube 26 to be added to or removed from the burner bore 20 as necessary to achieve a desired premixture flow characteristic.

Operation of the burner is accomplished as follows. After the fuel/air mixture 16 is introduced to the bore 20 of the flow tube 21, it is directed against the surfaces of the helical vanes 48 of the flow mixer 46 which imparts rotational motion or swirl to the premixture flow, as indicated by arrows A. The resulting swirling turbulent flow is then directed into a throat 50 of the burner outlet 23, and into the combustion chamber 28 of the furnace, where it is combusted and forms a burner flame. It is believed that this turbulent swirl imparted to the fuel/air mixture 16 results in a more complete distribution of the fuel and air components in the premixture 16, thereby providing a more complete and efficient fuel burn in the combustion chamber 28. Other exemplary structural configurations for delivering the fuel/air mixture 16 to the combustion chamber 28 are disclosed in our copending U.S. patent application No. 07/794,091, which is assigned to the assignee of this invention, and the disclosure of which is incorporated herein by reference.

Initial lighting of the burner 10 is accomplished by an ignition means, such as a spark plug 52, which ignites the combustible mixture 16 as it flows into the combustion chamber 28.

According to the prior art, the flame conditions within the combustion chamber 28 are generally determined by fuel/oxidant composition, delivery pressure, and the like. Thus, achieving increased flame temperatures in a reducing, i.e. fuel rich, atmosphere has been difficult to achieve because the requirement of additional oxidant for providing such higher operating temperatures is contrary to operating the burner in a fuel rich or reducing condition.

Depending on the combination of the premixed gaseous fuel and the ancillary gas used, the supply tube 26 of the present invention is manipulated in the axial direction to adjust flame temperature, shape, and chemistry by causing the ancillary gas to become entrained at a specific position adjacent to or within the flame. Should a high temperature with a reducing local atmosphere be desired, then the supply tube 26 is axially adjusted in conjunction with adjustment of the delivery pressure of the ancillary oxidant supply to provide that particular operating condition. Furthermore, rapid and precise axial adjustment of the supply tube 26 to accommodate changed furnace conditions as well as for the fine tuning of the burner 10 at those conditions may be achieved as described to enable the furnace operator to vary the point at which the ancillary gas flow is delivered within the combustion chamber proximate to the burner flame.

More specifically, accurate positioning of the first supply tube end 30, along the direction of the longitudinal axis 24, entrains the oxidant flow into the middle of the flame to produce a significantly higher flame temperature, e.g., 500° F. to 2000° F. greater than a premixed flame without oxygen enrichment. Thus, a substantially stoichiometric or reducing atmosphere can be maintained while increasing flame temperature thereby increasing production capability of the furnace. The resulting flame condition is viewable through the peep sight 34.

Figure 2:
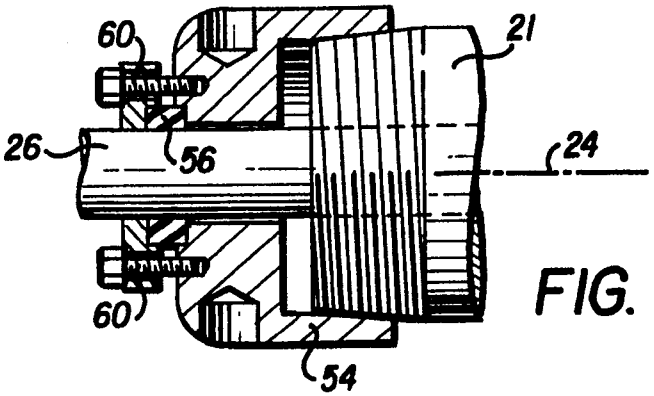
FIG. 2 is an enlarged fragmentary side view, partly in cross-section, of the gas supply tube adjustment means adjacent to the peep sight end of the burner body.

Now referring to FIG. 2 and according to the present invention, slidable axial adjustment of the gas tube 26 is enabled in the following manner. The outer end 32 of the supply tube 26 passes through a threaded cap 54, an elastomeric gasket 56, and flange 58. The gasket 56 is adapted to seal around and grip the end of the supply tube 26 extending through the cap 54. After the supply tube 26, and hence the first end 30 of the supply tube, has been slidably adjusted to the proper position along axis 24, the flange 58 is urged by two or more bolts 60 against the elastomeric gasket 56 to compress and urge it into circumferentially gripping relation with the supply tube 26 in the desired adjusted position.

A choice of one adjustment position over another will depend on a particular combination of fuel/air premixture flow and ancillary gas flow. For exemplary purposes only, the fuel component of either flow may be acetylene, ammonia, propane, butane, natural gas, or the like. Oxidants such as compressed atmospheric air, purified oxygen, or other gaseous oxidants may be used both in the fuel/oxidant premixture as well in the ancillary flow through the supply tube 26.

Although only a preferred embodiment has been specifically illustrated and described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A method of operating a burner apparatus for use with a metal processing furnace having a combustion chamber fired by a premixed gaseous fuel, said burner apparatus comprising a burner body having a fuel inlet and an outlet and a central bore communicating said inlet with said outlet, a supply tube disposed in said burner body for directing a secondary gas flow into said combustion chamber, said supply tube having a first end adjacent said outlet and means coupled to said supply tube and operable from outside the burner body for adjusting the axial position of the first end of said supply tube in relation to said outlet, the method comprising:

directing a flow of premixed gaseous fuel through the inlet of the burner body and into the combustion chamber;

igniting the fuel flow passing into said combustion chamber to create a flame therein;

directing said secondary gas flow through said supply tube and into the flame in the combustion chamber; and adjusting the axial position of the first end of said supply tube from outside the furnace during operation thereof to adjust the burner flame in the combustion chamber.

2. The method of claim 1, wherein said directing step includes the step of directing an oxidant through said supply tube to increase the temperature of said flame.

3. The method of claim 1, wherein said combustion chamber has a reducing atmosphere and wherein said directing and adjusting steps include the steps of directing an oxidant through said supply tube and adjusting the axial position of the first end of the supply tube so as to increase the temperature of the burner flame while maintaining a reducing atmosphere in said furnace.

4. The method of claim 1, wherein said directing step includes the step of directing a fuel component through said supply tube to increase the richness of the burner flame.

5. The method of claim 1, comprising the additional step of imparting a turbulent swirl to the flow of premixed gaseous fuel in said burner body.

6. The method of claim 1, wherein said adjusting step includes the step of viewing the flame in the combustion chamber.

* * * * *